US005556315A

United States Patent [19]

Kagawa

[11] Patent Number: 5,556,315

[45] Date of Patent: Sep. 17, 1996

[54] METHOD OF MAKING A SPARK PLUG FOR AN INTERNAL COMBUSTION ENGINE

[75] Inventor: Junichi Kagawa, Nagoya, Japan

[73] Assignee: NGK Spark Plug Co., Ltd., Nagoya, Japan

[21] Appl. No.: 468,952

[22] Filed: Jun. 6, 1995

Related U.S. Application Data

[62] Division of Ser. No. 268,546, Jul. 6, 1994, abandoned.

[30] Foreign Application Priority Data

Jul. 6, 1993 [JP] Japan ..... 5-167073
Jul. 6, 1993 [JP] Japan ..... 5-167074

[51] Int. Cl.[6] ..... H01T 21/02

[52] U.S. Cl. ..... 445/7; 445/49

[58] Field of Search ..... 445/7, 49

[56] References Cited

U.S. PATENT DOCUMENTS

| | | | |
|---|---|---|---|
| 2,003,464 | 6/1935 | Rabezzana | 29/155.51 |
| 2,296,033 | 9/1942 | Heller | 445/7 |
| 4,329,174 | 5/1982 | Ito et al. | 420/433 |
| 4,700,103 | 10/1987 | Yamaguchi et al. | 313/141 |
| 4,893,051 | 1/1990 | Kondo | 313/141 |

FOREIGN PATENT DOCUMENTS

| | | | |
|---|---|---|---|
| 0171994 | 2/1986 | European Pat. Off. . | |
| 518707A2 | 12/1992 | European Pat. Off. | 445/7 |
| 1365880 | 5/1964 | France . | |
| 9110600.1 | 2/1992 | Germany . | |
| 2-49388 | 2/1990 | Japan . | |
| 6-84582A | 3/1994 | Japan | 445/7 |
| 1564335 | 4/1980 | United Kingdom . | |

*Primary Examiner*—P. Austin Bradley
*Assistant Examiner*—Jeffrey T. Knapp
*Attorney, Agent, or Firm*—Sughrue, Mion, Zinn, Macpeak & Seas

[57] ABSTRACT

A method of making a spark plug involves securing an outer electrode to a metallic shell so that at least a portion of the outer electrode is directed inwardly of a front open end of the metallic shell. The outer electrode has an inner surface, an outer surface, and an end surface. A center electrode is supported in an insulator in the metallic shell. A spark-erosion resistant noble metal tip is attached to the outer surface of the outer electrode with a predetermined distance between an elevational side of the center electrode and one end of the spark-erosion resistant noble metal tip.

10 Claims, 12 Drawing Sheets

METHOD OF MAKING A SPARK PLUG FOR AN INTERNAL COMBUSTION ENGINE

This is a divisional of application Ser. No. 08/268,546 filed Jul. 6, 1994.

BACKGROUND OF THE INVENTION

1. Field of the Invention

This invention relates to a spark plug and a method of making the spark plug in which a spark gap is provided between an elevational side of a center electrode axially extended in an tubular insulator and one end of a first spark-resistant noble metal tip secured to an outer electrode.

2. Description of Prior Art

In a spark plug for an internal combustion engine, the following techniques have been used to secure a spark-erosion resistant noble metal or noble metal alloy tip to an outer electrode.

(i) As a noble metal tip 121, a thin layer of Pt—Ir or Pt—Ni alloy is welded to one end of an outer electrode 120 in a manner to oppose an elevational side of a center electrode 110 of a spark plug 100 as shown in FIG. 16.

(ii) A noble metal elongation 122 is secured to one end of the outer electrode 120 by means of argon welding in a manner to oppose an elevational side of the center electrode 110 of the spark plug 100 as shown in FIG. 17.

(iii) A noble metal tip 123 is welded to an upper side 120*a* of the outer electrode 120 in a manner to oppose a front end 110*a* of the center electrode 110 as shown in FIG. 18.

(iv) A short pedestal 220 is placed on a front end 210*a* of a metallic shell 210 in a direction according to an extension of the metallic shell 210. Then a spark-resistant noble metal tip 230 is prepared from Pt—Ir or Pt—Ni alloy, and secured to one end of an outer electrode 240. Thereafter, the outer electrode 240 is secured to the short pedestal 220 by means of electric resistance welding. During the welding procedure, a spacer 260 is used to provide a spark gap between the tip 230 and a center electrode 250 as shown in FIG. 19.

In the technique (i), a variation may be induced in a lateral arm 120*b* of the outer electrode 120 to deteriorate its dimensional accuracy upon bending the outer electrode 120 into the L-shaped configuration after welding the thin layer of noble metal tip 121 to one end of the outer electrode 120. When the tip 121 is welded to the outer electrode 120 once the outer electrode is bent into the L-shaped configuration, it is troublesome to weld the tip 121 so as to only deteriorate mass production since one end of the outer electrode 120 is located to oppose the elevational side of the center electrode 110. The thin layer of the tip 121 shortens a distance between the one end of the outer electrode and the elevational side of the center electrode 110 so as to worsen the ignitibility due to an increased flame-extinguishing effect.

In the technique (ii), a variation may be induced in the lateral arm 120*b* of the outer electrode 120 to deteriorate its dimensional accuracy upon bending the outer electrode 120 into the L-shaped configuration, after argon welding the noble metal elongation 122 to one end of the outer electrode 120. When the noble metal elongation 122 is welded to the outer electrode 120 after bending the L-shaped configuration, it is troublesome to thermally weld the elongation 122 since one end of the outer electrode 120 is located to oppose the elevational side of the center electrode 110. Consequently, mass production is difficult.

In the technique (iii), the lateral arm 120*b* of the outer electrode 120 is likely to increase its weight unilaterally since a total length (L1+L2) of the outer electrode 120 is longer than in a lateral discharge type spark plug, in addition to the fact that the noble metal tip 123 is welded to the upper side of the outer electrode 120. This makes it possible to break down the outer electrode when exposed to persistent vibration. The technique (iii) also has an unfavorable tendency to require a high discharge voltage when the positive polarity voltage is applied to the center electrode.

In the manufacturing method (iv), an excessive pressure may be applied to the pedestal 220 so as to unfavorably deform the pedestal 220 due to the electric resistance welding upon securing the outer electrode 240 to the pedestal 220. The deformed pedestal causes a change in the height of the outer electrode 240 so as to adversely affect the performance of the spark plug although the required spark gap is maintained.

Therefore, it is an object of the invention provide a spark plug which is capable of preventing the outer electrode from being broken down when exposed persistent vibration, and readily welding the spark-erosion resistant noble metal tip while maintaining a good ignitibility with less flame extinguishing effect.

It is another object of the invention to provide a method of making a high quality spark plug which is capable of obviating the necessity of adjusting a spark gap after the spark-erosion resistant noble metal tip is secured to the outer electrode in a spark plug in which the spark gap is provided between an elevational side of a center electrode axially extended along a tubular insulator and one end of a first spark-erosion resistant noble metal tip secured to an outer electrode.

SUMMARY OF THE INVENTION

According to the invention, there is provided a spark plug including a cylindrical metallic shell, a tubular insulator supported within the metallic shell and a center electrode provided to axially extend within the insulator. An outer electrode is secured to a front end of the metallic shell in a manner to extend toward an elevational side of the center electrode. A first spark-erosion resistant noble metal tip is secured to an outer surface of the outer electrode which extends across a front open end of the metallic shell so as to form a spark gap between the extended end of the tip and the elevational side of the center electrode.

According to the invention, a plurality of outer electrodes or a single outer electrode is provided to the front end of the metallic shell.

According to another aspect of the invention, a second spark-erosion resistant noble metal tip is welded to a front end surface of the center electrode so as to form the spark gap with the extended end of the first spark-erosion resistant noble metal tip.

According still another aspect of the invention, a second spark-erosion resistant noble metal layer is provided to a circumferential side of the front end of the center electrode so as to form the spark gap with the extended end of the first spark-erosion resistant noble metal tip, the second spark-erosion resistant noble metal layer being formed by means of a cold working technique or welding procedure including laser beam welding.

According to the invention, there is provided a method of making a spark plug in which a spark gap is provided between an elevational side of a center electrode axially extended in an tubular insulator and one end of a first spark-erosion resistant noble metal tip secured to an outer electrode. The method includes steps of providing an outer electrode to a front end of a metallic shell, providing an insulator in the metallic shell to support a center electrode therein; and placing a first spark-erosion resistant noble metal tip on an outer surface of the outer electrode which extends across a front open end of the metallic shell while maintaining a certain distance between an elevational side of a center electrode and one end of the first spark-erosion resistant noble metal tip, and the tip being secured to the outer electrode by thermally welding an interface between the tip and the outer electrode.

According to another aspect of the invention, a certain distance between an elevational side of a center electrode and one end of the first spark-erosion resistant noble metal tip is a predetermined amount smaller than the spark gap at the step (c).

According to another aspect of the invention, the step of providing the outer electrode includes a first procedure of welding the bar-shaped outer electrode to the metallic shell, and a second procedure of bending the outer electrode substantially into an L-shaped configuration so that the bending end of the outer electrode is directed inward of the metallic shell.

According to still another aspect of to the invention, an inward end of the outer electrode is physically cut to adjust the inward position of the outer electrode after bending the outer electrode substantially into an L-shaped configuration in said second procedure.

According to yet another aspect of the invention, a plurality of outer electrtodes are provided, and all the outer electrtodes are concurrently bent into an L-shaped configuration.

With the first spark-erosion resistant noble metal tip secured to an outer surface the outer electrode which extends across the front open end of the metallic shell, it is possible to readily secure the tip to the outer electrode. With one end of the bar-shaped tip extended toward the center electrode, it is possible to afford a relatively long distance between the extended end of the outer electrode and the center electrode, and thus enabling to significantly improve the ignitibility by weakening the flame extinguishing effect caused from the presence of the extended end of the outer electrode. With one end of the outer electrode opposed to the elevational side of the center electrode, it is possible to shorten an entire length of the outer electrode. This makes it possible to protect the outer electrode against the breakage when exposed to persistent vibration.

With a plurality of outer electrodes or a single outer electrode provided to the front end of the metallic shell, it is possible to set the flame extinguishing effect under control so as to effectively avoid the ignitibility from deteriorating when applied to a multi-electrode type spark plug which has more than two outer electrodes.

With the second spark-erosion resistant noble metal tip welded to a front end surface of the center electrode so as to form the spark gap with the extended end of the first spark-erosion resistant noble metal tip, it is possible to reduce the spark erosion so as to substantially do away with Check and maintenance of the spark plug.

With the second spark-erosion resistant noble metal layer is provided to a circumferential side of the front end of the center electrode so as to form the spark gap with the extended end of the first spark-resistant noble metal tip, it is possible to reduce the spark erosion so as to substantially do away with check and maintenance of the spark plug.

With the first spark-erosion resistant noble metal tip secured to an outer surface the outer electrode which extends across the front Open end of the metallic shell, it is possible to readily weld the tip to the outer electrode with the insulator and the center electrode placed in the metallic shell. During the welding procedure, it is possible to obviate the necessity of adjusting the spark gap after the completion of the welding procedure since the welding procedure is done while maintaning a certain distance between an elevational side of a center electrode and one end of the first spark-erosion resistant noble metal tip. Further it is not necessary to force a pressure to tightly engage the tip against the outer electrode because the tip is secured to the outer electrode by thermally welding an interface between the tip and the outer electrode. The obviation of the forced pressure makes it possible to prevent the outer electrode from unfavorably deforming so as to provide a high quality spark plug.

With the certain distance maintained smaller than the spark gap between an elevational side of a center electrode and one end of the first spark-erosion resistant noble metal tip while welding the tip to the outer electrode, it is possible to meet the certain distance to the spark gap after the completion of the welding procedure because the tip is subjected to thermal contraction in a lengthwise direction after being cooled by releasing heat stored in the tip.

With the outer electrode substantially bent into the L-shaped configuration, so that the bending end of the outer electrode is directed inward of the front open end of the metallic shell, it is possible to apply the tip to a wide variety of spark plugs.

With the inward end of the outer electrode physically cut to adjust the inward position of the outer electrode after bending the purer electrode substantially into an L-shaped configuration in said second procedure, it is possible to readily bend the outer electrode smoothly by using a longer one.

With a plurality of outer electrodes concurrently bent into the L-shaped configuration, it is possible to reduce the number of procedures as opposed to the case in which the outer electrodes are individually bent into the L-shaped configuration.

These and other objects and advantages of the invention will be apparent upon reference to the following specification, attendant claims and drawings.

BRIEF DESCRIPTION OF THE DRAWINGS

FIG. 1 is an enlarged perspective view of a main part of a spark plug according to a first embodiment of t he invent i on;

FIG. 3 is an enlarged perspective view of a main part of a spark plug according to a second embodiment of t he invent i on;

DETAILED DESCRIPTION OF THE PREFERRED EMBODIMENTS OF THE INVENTION

Figure 1:
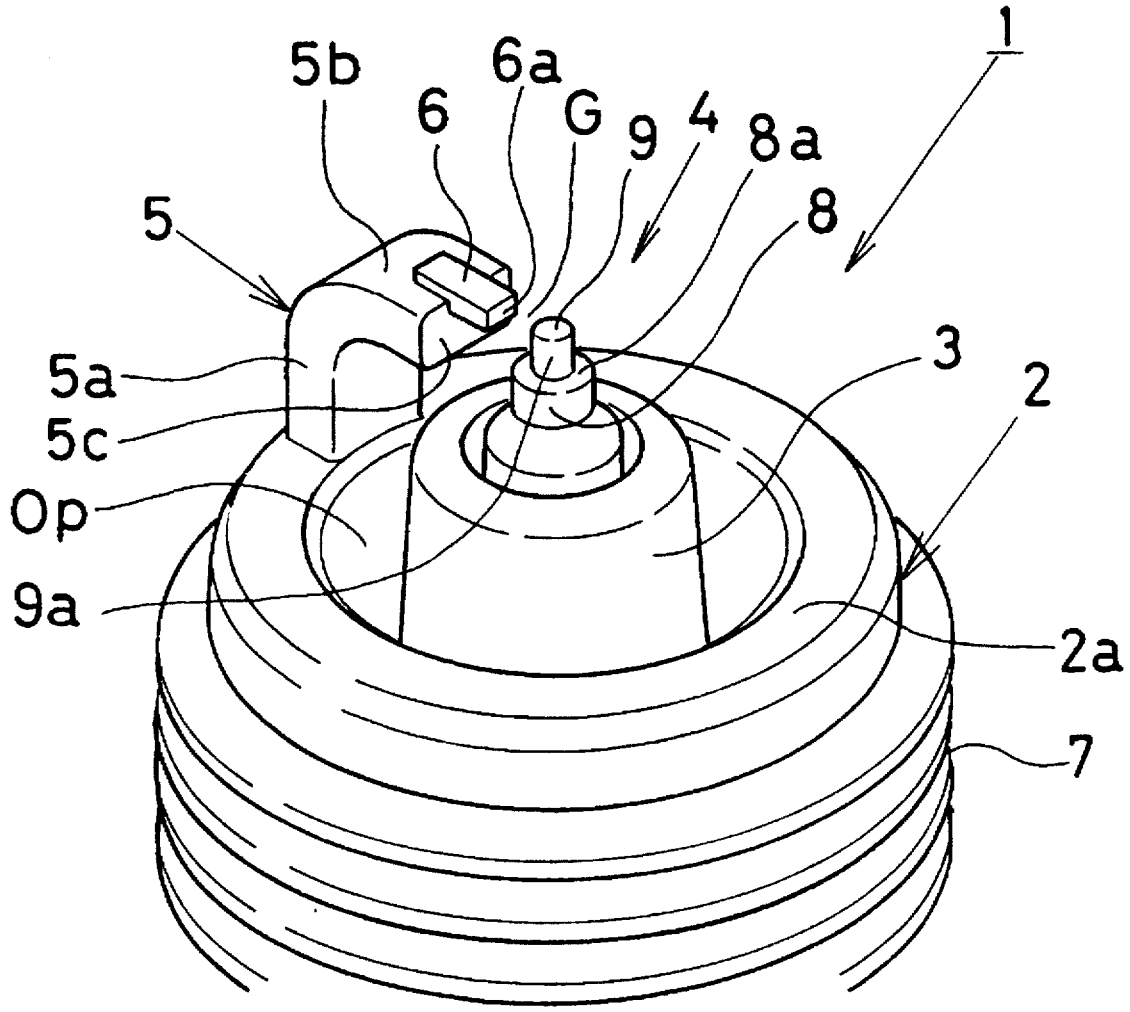
Figure 2:
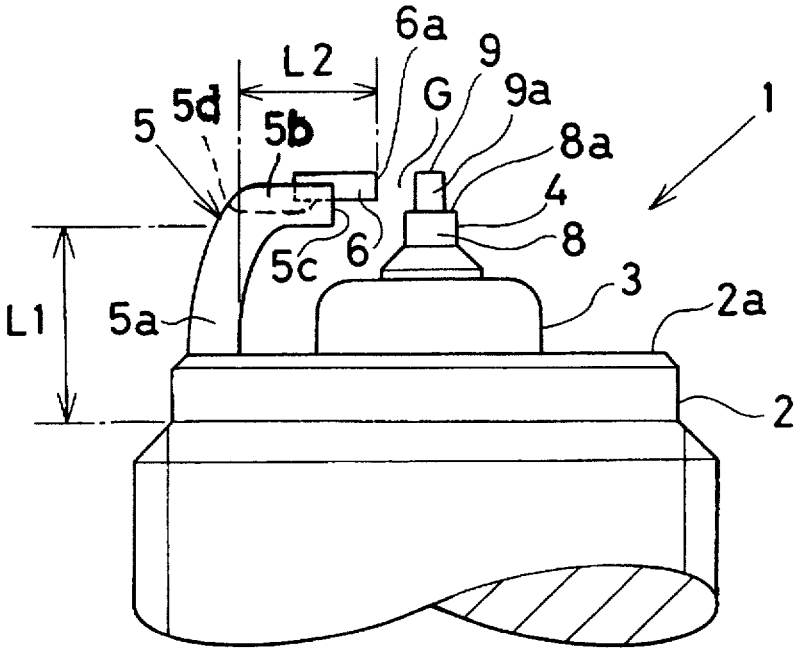
FIG. 2 is a side elevational view of a main part of a spark plug.

Referring first to FIGS. 1 and 2 which show a spark plug 1 according to a first embodiment of the invention, the spark plug 1 has a cylindrical metallic shell 2 through which the spark plug 1 is mounted on an internal combustion engine; (not shown). Within the metallic shell 2, a tubular insulator 3 is supported in which a center electrode 4: is axially extended. To a front end 2*a* of the metallic shell 2, an L-shaped outer electrode 5 is secured by way of its vertical arm 5*a*, while a lateral arm 5*b* of the outer electrode 5 extends across a front open end (Op) of the metallic shell 2. On an outer side of the lateral arm 5*b* located opposite to the front open end (Op) of the metallic shell 2, a first spark-erosion resistant noble metal tip 6 is provided.

The metallic shell 2 is made of an electrically conductive metal such as iron-based metal, low carbon steel or the like, and having a male thread portion 7 through which the metallic shell 2 is secured by way of a hexagonal nut (not shown) to a cylinder head of the internal combustion engine.

The insulator 3 is made of heat-resistant material such as ceramic body sintered from alumina or the like. The insulator 3 is formed into a tubular configuration so as to support the center electrode 4 therein in electrically insulating relationship with the center electrode 4.

The center electrode is made of an electrically conductive bar to which a high voltage is applied by an ignition device (not shown). The center electrode 4 further constitutes a composite structure having a nickel-based clad metal 8 in which a copper-based core is embedded. To a front end surface 8*a* of the clad metal 8 which is slightly extended beyond the insulator 3, a second spark-erosion resistant noble metal tip 9 is secured by a use of welding technique. By way of illustration, the noble metal tip 9 is made of a columnar Pt—Ir alloy superior in spark-erosion resistant property.

The outer electrode 5 is arranged to be connected to the internal combustion engine by way of the metallic shell 2 for the purpose of grounding. The outer electrode. 5 constitutes a composite electrode having a corrosion resistant metal such as nickel-based alloy, inconel (Ni—Cr—Fe alloy) or a heat-Conductive core (e.g. copper, copper-based alloy) cladded by a heat and corrosion resistant metal such as nickel-based alloy, inconel or the like. The outer electrode 5 is secured to the front end 2*a* of the metallic shell 2 by a use of welding technique such as electric resistance welding or the like. The vertical arm 5*a* of the outer electrode 5 extends upright from the front end 2*a* of the metallic shell 2, and extends cross the front open end (Op) of the metallic shell 2 so as to form the L-shaped configuration as a whole. A front end 5*c* of the outer electrode 5 comes opposes an elevational side 9*a* of the second spark-erosion resistant noble metal tip 9. A distance between the front end 5*c* of the outer electrode 5 and the elevational side 9*a* of the tip 9 a predetermined amount longer than a spark gap G as described in detail hereinafter. The first spark-erosion resistant noble metal tip 6 is made of columnar platinum-based alloy (Pt—It, Pt—Ni alloy) for example which is rectangular in cross section with its cross sectional area less than 1 $mm^2$. The tip 6 is secured to the outer side of the lateral arm 5*b* of the outer electrode 5 by a welding technique such as laser beam welding, electron beam welding or the like i.e., technique to provide radiation heat at an interface between the tip 6 and an outer surface of the outer electrode 5. One end 6*a* of the tip 6 extends beyond the front end 5*c* of the outer electrode 5 toward the elevational side 9*a* of the tip 9 so as to form the spark gap G therebetween. In this instance, the first spark-erosion resistant noble metal tip 6 is fitted into a recess 5*d* (FIG. 2) provided on the outer side of the outer electrode 5. Upon applying a high voltage to the center electrode 4 from the ignition device, a spark discharge appears across the spark gap G between the one end 6*a* of the tip 6 and the elevational side 9*a* of the tip 9 due to a high potential difference between the center electrode 4 and the outer electrode 5.

According the invention, the first spark-erosion resistant noble metal tip 6 is secured to the outer side of the lateral arm 5*b* opposite to the front open end (Op) of the metallic shell 2. This makes it possible to readily assemble the tip 6 to the outer electrode 5 so as to facilitate a mass production.

With the first spark-erosion resistant noble metal tip 6 extended beyond the outer electrode 5 toward the elevational side 9*a* of the second spark-erosion resistant noble metal tip 9, it is possible to obtain a longer distance between the front end 5*c* of the outer electrode 5 and the center electrode 4. This weakens the flame extinguishing effect caused from the presence of the front end 5*c* of the outer electrode 5.

Figure 18:
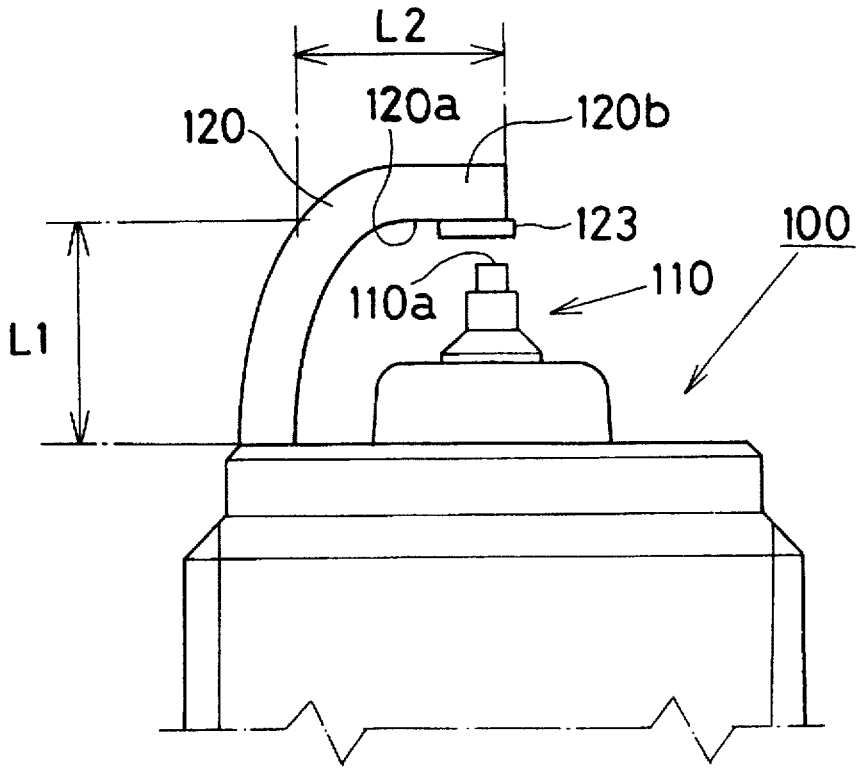
Fig. 18 PRIOR ART
Figure 19:
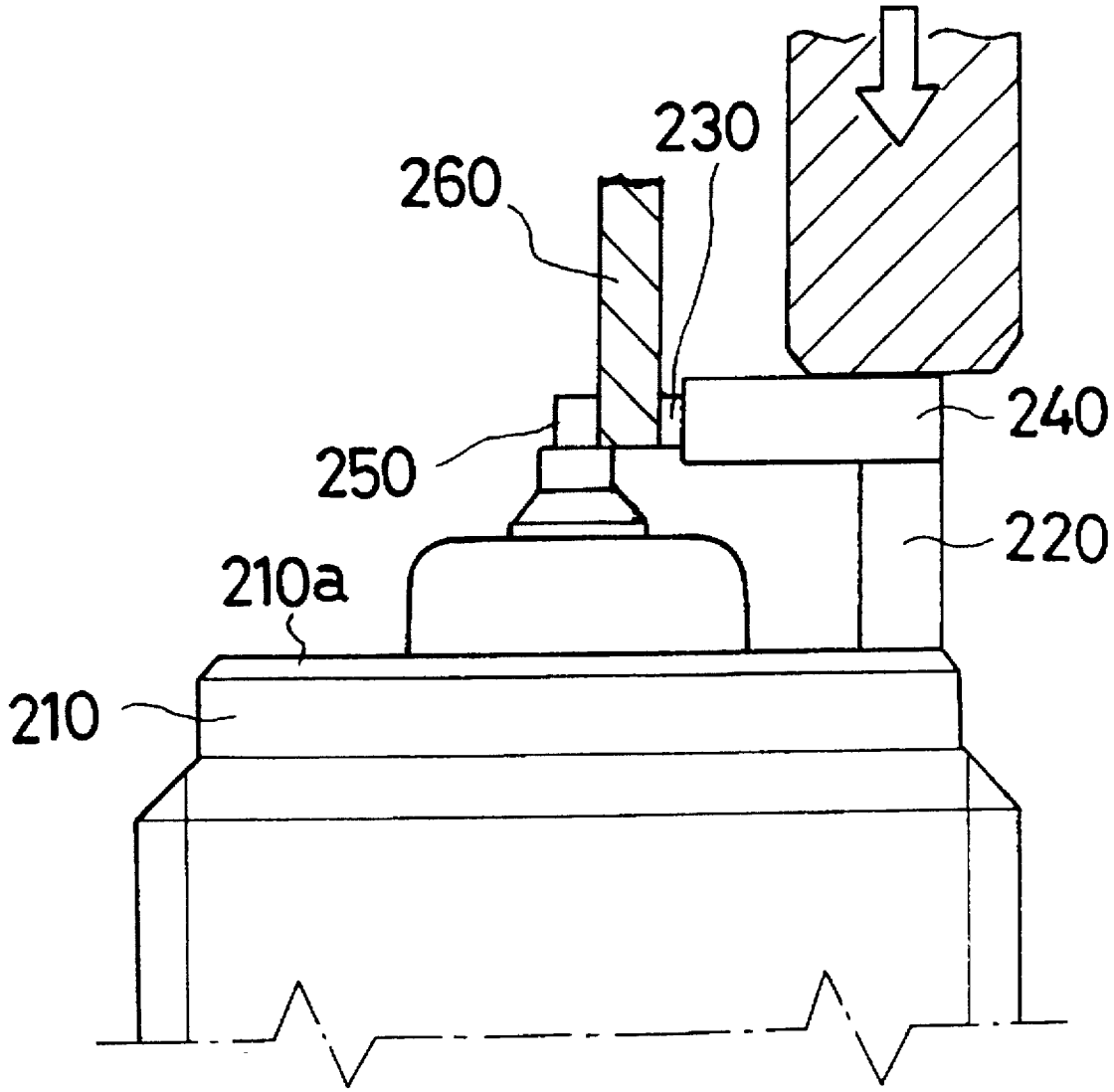
Fig. 19 PRIOR ART

With the first spark-erosion resistant noble metal. tip 6 secured to the outer side of the outer electrode 5 as shown in FIG. 2, it is possible to shorten the length (L1) of the vertical arm 5*a* as compared to the counterpart arm of FIG. 18. The securement of the tip 6 also makes it possible to shorten the length (L2) of the lateral arm 5*b* as compared to the counterpart arm of Fig. 18, thus reducing an entire length (L1+L2) of the outer electrode 5 to substantially protect the outer electrode 5 against breakage when subjected to persistent vibration.

With the use of the first and second spark-erosion resistant noble metal tips 6, 9, it is possible to significantly reduce the spark erosion for repeated times of spark discharges across the spark gap G, thus prolonging a service life of the spark plug 1 and decreasing the frequency of check and maintenance for an extended period of time.

Figure 3:
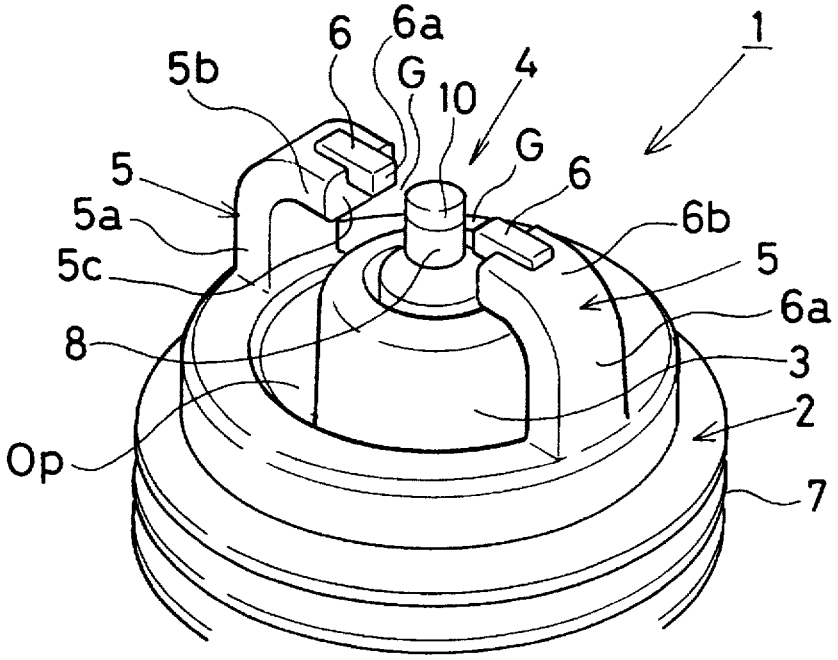
Figure 4:
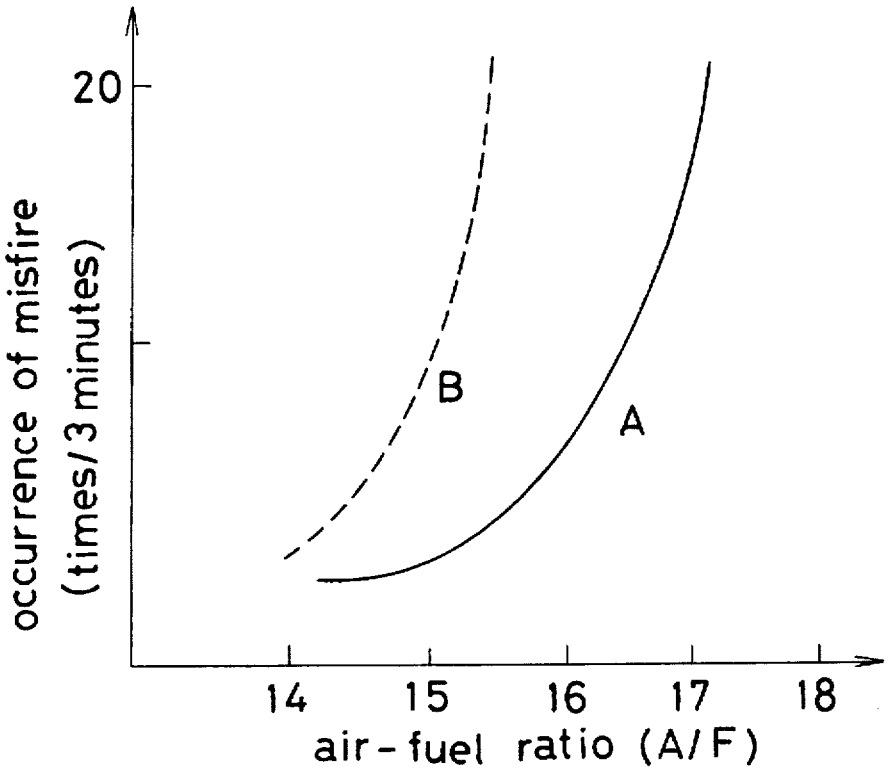
FIG. 4 is a graph showing a relationship between an air-fuel ratio (A/F) and an occurrence of misfire.

FIGS. 3, 4 show a second embodiment of the invention in which diametrically opposed outer electrodes 5, 5 are employed on the spark plug 1. On the outer side of the outer electrodes 5, 5, the first spark-erosion resistant noble metal tip 6 is placed by means of an appropriate welding technique. One end 6*a* of the tip 6 extends beyond the outer electrode 5 toward a spark-erosion resistant noble metal layer 10 of the center electrode 4 so as to form the spark gap G therebetween. On a circumferential wall of the front end of the clad metal 8, the spark-erosion resistant noble metal layer 10 is provided by means of a welding technique such as laser beam welding, electron beam welding or the like 1 or by means of a cold working technique. The noble metal layer 10 maybe made of platinum 1, for example. Of course, three or more outer electrodes could be used instead of mono-or dual-outer electrode.

Figure 16:
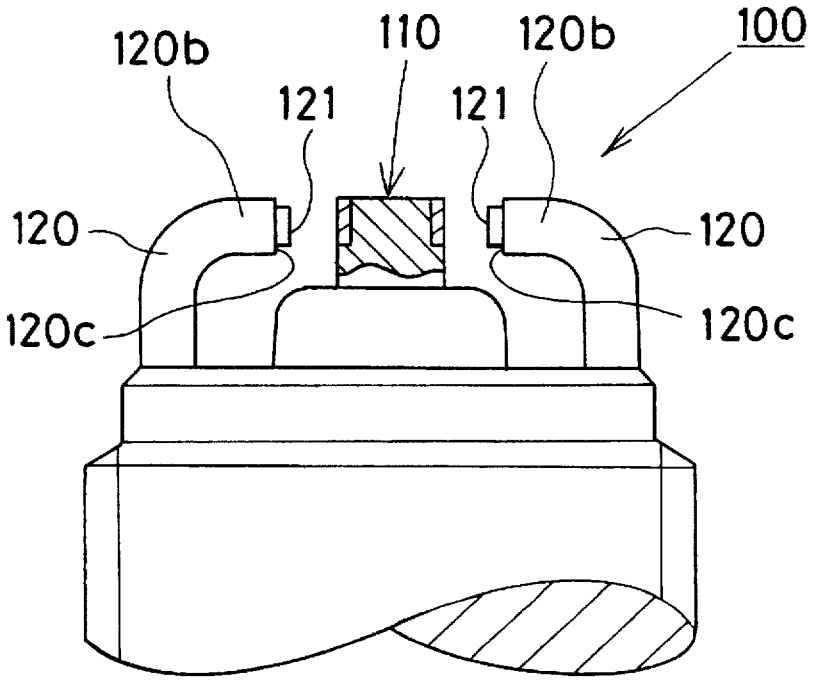
Fig. 16 PRIOR ART
FIGS. 16 through 19 are counterpart techniques showing how a noble metal tip has been welded to an spark plug electrode.
Figure 17:
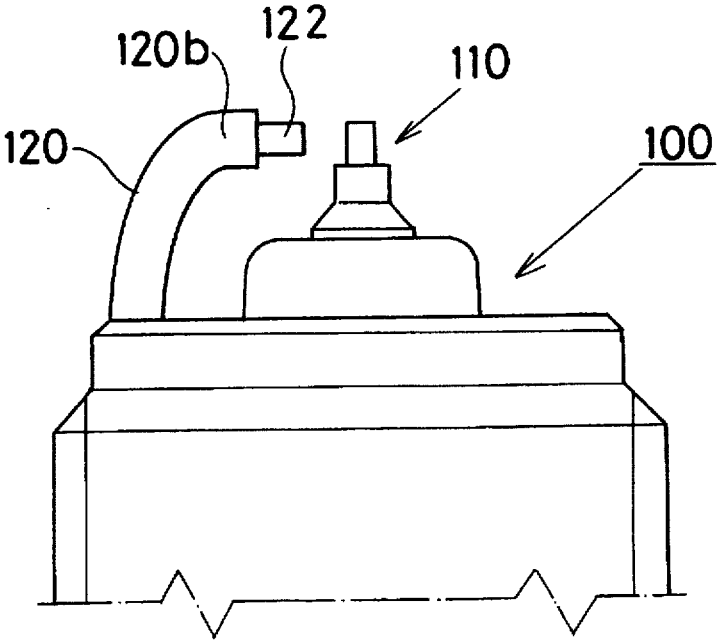
Fig. 17 PRIOR ART

An experimental test was carried out to compare the ignitibility of the spark plug 1 and that of the counterpart spark plug 100 (referred to in FIG. 16) at the early time of starting the engine.

The experimental test result is shown by a graph characteristic of ignitible limit air-fuel ratio in FIG. 4. The graph depicts a relationship between an occurrence of misfire and an air-fuel ratio (A/F). As found from the broken lines B in FIG. 4, the thin layer of the noble metal tip makes the distance shorter between the center electrode 110 and a front end 120*c* of the outer .electrode 120 in the counterpart spark plug 100. This makes the presence of the front end 120*c* of the outer electrode 120 dominant so as to deteriorate the ignitibility under the influence of the flame distinguishing effect.

On the contrary, due to the first spark-erosion resistant noble metal tip 6 being made of a bar-shaped configuration, it is possible to lengthen the distance between the center electrode 4 and the front end 5*c* of the outer electrode 5 in the spark plug 1 as shown by the solid line A in FIG. 4. This makes the presence of the front end 120*c* of the outer electrode 120 weaker so as to improve the ignitibility with less influence of the flame distinguishing effect.

Figure 5:
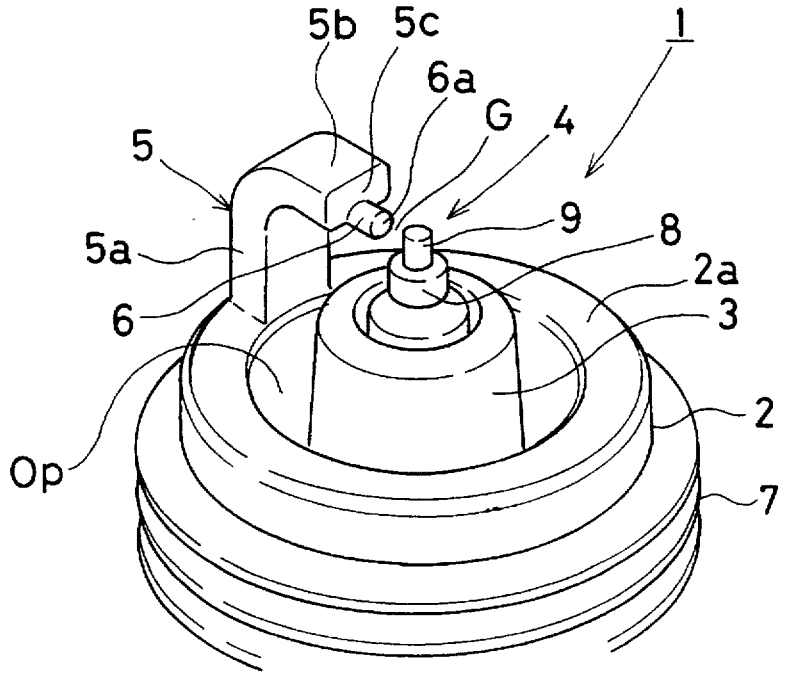
FIG. 5 is a perspective view of a main part of a spark plug according to a third embodiment of the invention.

FIG. 5 shows a third embodiment of the invention in which the first spark-erosion resistant noble metal tip 6 is welded to an inner side of the lateral arm 5*b* of the outer electrode 5 which directly faces the front open end (Op) of the metallic shell 2. The first spark-erosion resistant noble metal tip 6 is made of a columnar metal having a diameter of less than 1 mm.

It is noted that the cross section of the tip 6 may be triangular pentagonal or polygon so long as the tip 6 is secured to the outer or inner side of the ground electrode 5 with the end of the tip 6 extended toward the center electrode 4.

It is also noted that the tips 6, 9 and the layer 10 may be made of iridium, palladium, rhodium, gold or alloys of these metals instead of platinum only.

It is to be appreciated that the outer electrode may be linearly directed to the center electrode from an inner wall of the metallic shell instead of the L-shaped outer electrode, otherwise the outer electrode may be integral with the front end of the metallic shell as in the case of alp discharge type or semi-creeping discharge type spark plugs, and a single tip of plurality of tips may be provided on an annular end of the outer electrode.

It is observed that the front end surface (firing portion) of the center electrode may be devoid of the tip 9 and layer 10.

Referring further to FIGS. 6 through 12, the method of making the spark plug 1 is as follows:

Step 1

Figure 6:
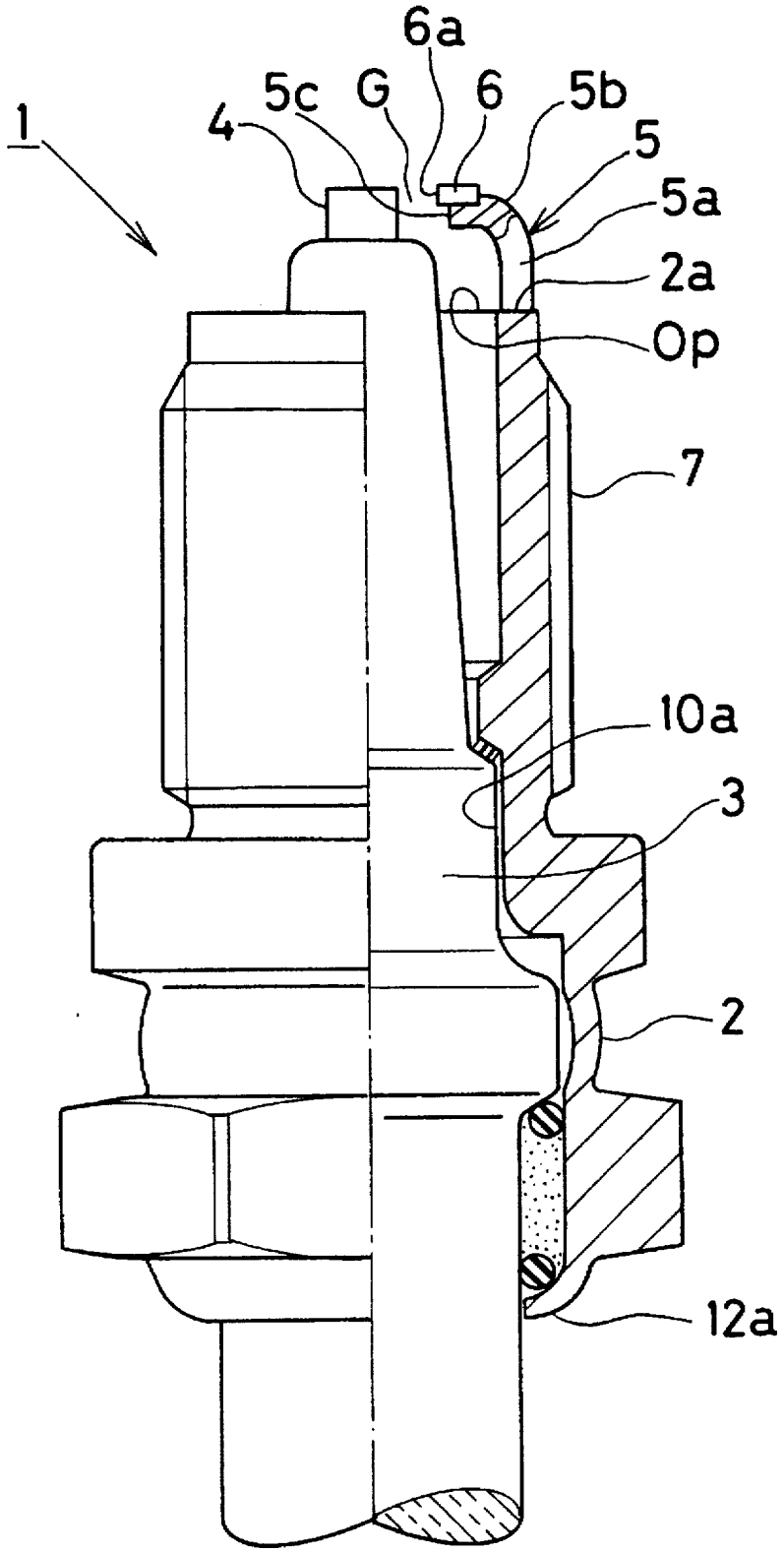
FIG. 6 is a plan view of a spark plug according to a method of making the spark plug but partly sectioned for the purpose of clarity.
Figure 7:
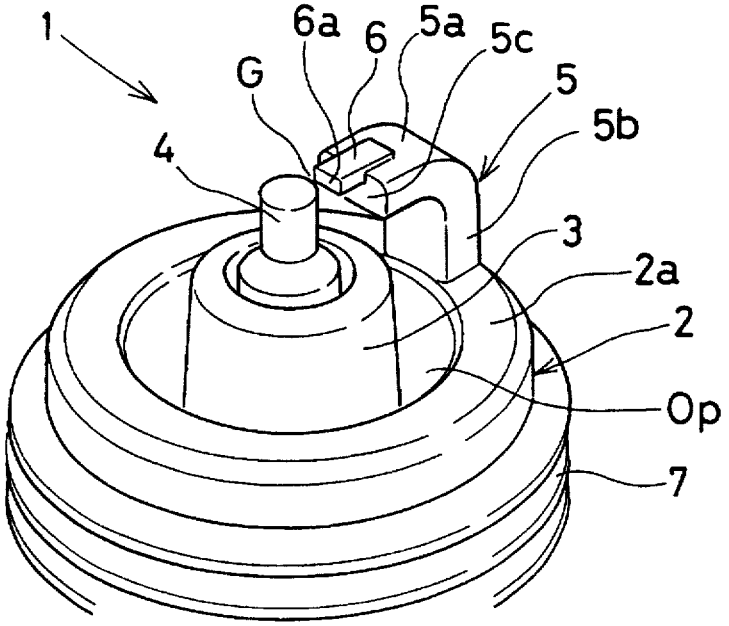
FIG. 7 is an enlarged perspective view of a main part of the spark plug.
Figure 8:
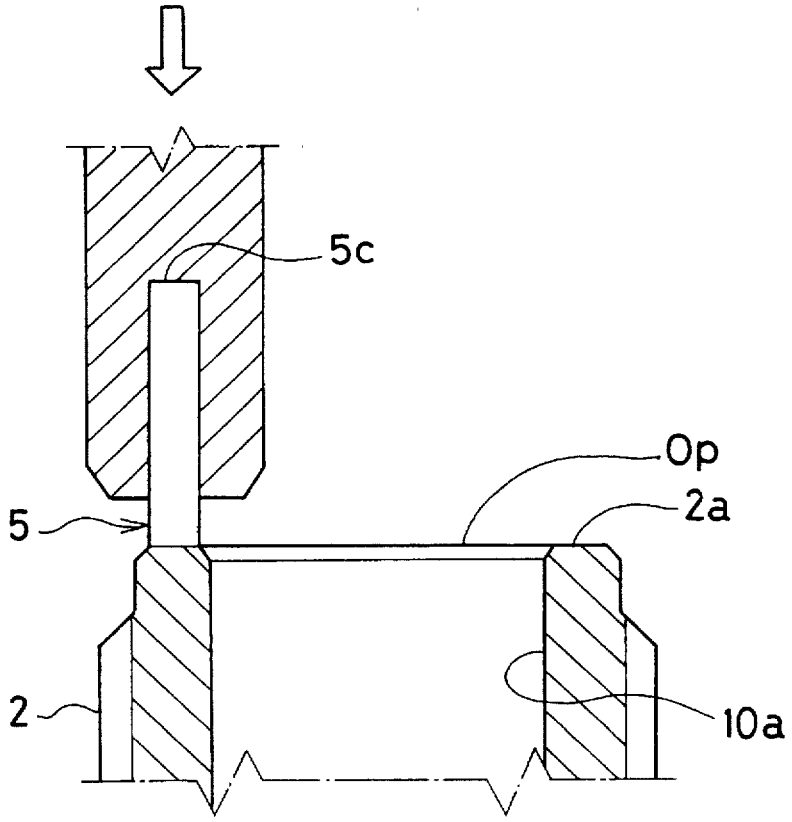
FIG. 8 is a longitudinal cross sectional view showing how an outer electrode is secured to a front end of a metallic shell.

Before being assembled as shown in FIGS. 6, 7, the outer electrode 5 is formed into a bar-like configuration with its cross section as a rectangle, and is secured to the annular front end 2*a* of the metallic shell 2 by means of a welding technique such as electric resistance welding or the like as shown in FIG. 8. In this instance, the lengthwise dimension of the outer electrode 5 is a predetermined amount long at considering so that the outer electrode 5 is readily and positively bent into the L-shaped configuration in the next step.

Step 2

Figure 9:
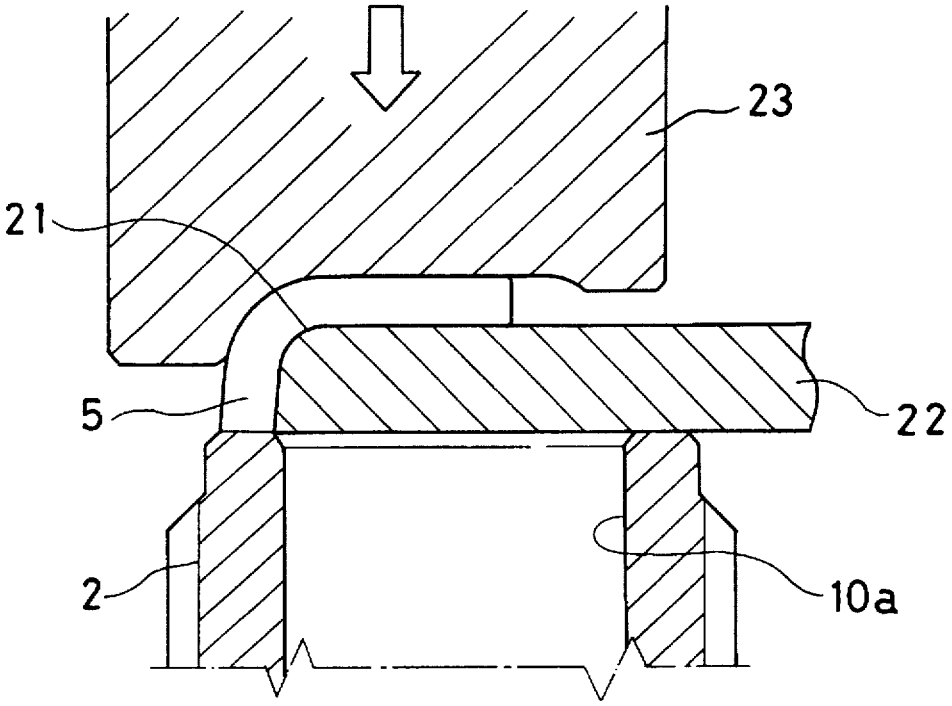
FIG. 9 is a longitudinal cross sectional view showing how the outer electrode is bent into an L-shaped configuration.

The bar-like outer electrode 5 is substantially bent into the L-shaped configuration toward the front open end (Op) of the metallic shell 2 as shown in FIG. 9. In this instance, the lateral arm 5*b* of the outer electrode 5 extends across the front open end (Op) of the metallic shell 2 in a direction perpendicular to the axial direction of the metallic shell 2. The step is carried out with the use of a bending machine having an inner die 22 and a punch 23. The inner die 22 has a forming surface 21 in correspondence to a bending degree of the outer electrode 5, while the punch 23 moves downward along the axial direction of the metallic shell 2 to depress the outer electrode 5 against the forming surface 21 so as to plastically form the outer electrode 5 into the L-shaped configuration. It is observed that the outer electrode 5 is readily and positively bent into the L-shaped configuration without inviting a locally concentrated stress made because the lengthwise dimension of the outer electrode 5 is a predetermined amount longer at the preceding step.

Step 3

Figure 10:
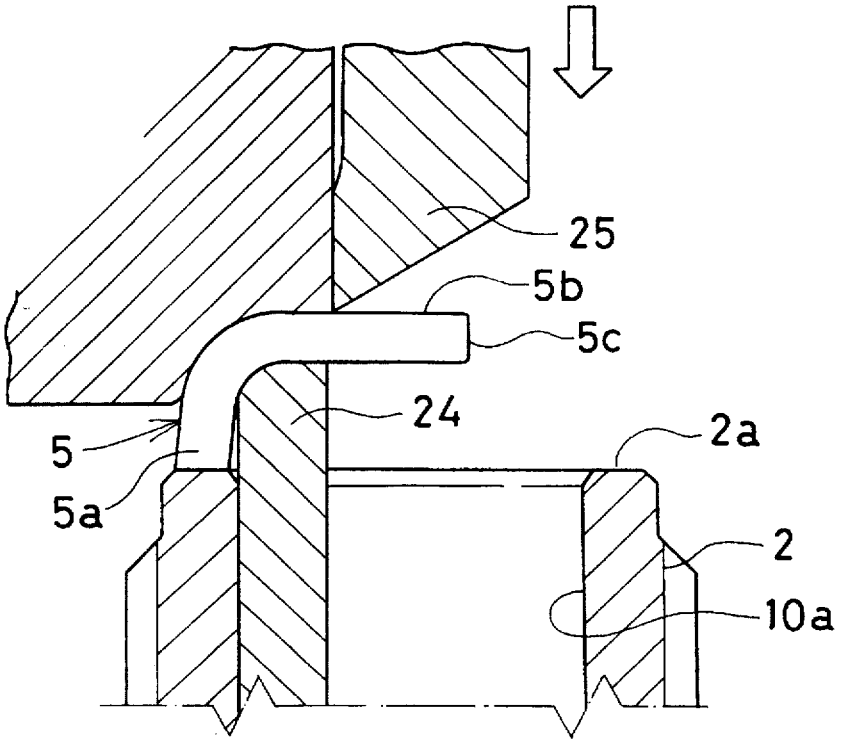
FIG. 10 is a longitudinal cross sectional view showing how an unnecessary end of the outer electrode is physically cut.

An unnecessary end of the outer electrode 5 is physically cut to adjust the lengthwise dimension of the lateral arm 5*b* by using a cutting machine. The cutting machine includes a pedestal tool 24 and a cutter punch 25. The pedestal tool 24 is placed in an axial bore 10*a* to underline the lateral arm 5*b* of the outer electrode 5, while the cutter punch 25 moves downward to sever the unnecessary end of the lateral arm 5*b* of the outer electrode 5 as shown in FIG. 10. At the time of cutting the outer electrode 5, the recess 5*d* is be provided on the outer side of the lateral arm 5*b* of the outer electrode 5 in order to place the tip 8 therein. The unnecessary end of the outer electrode 5 may be severed by moving the cutter punch 25 upward instead of moving it downward.

Step 4

Figure 11:
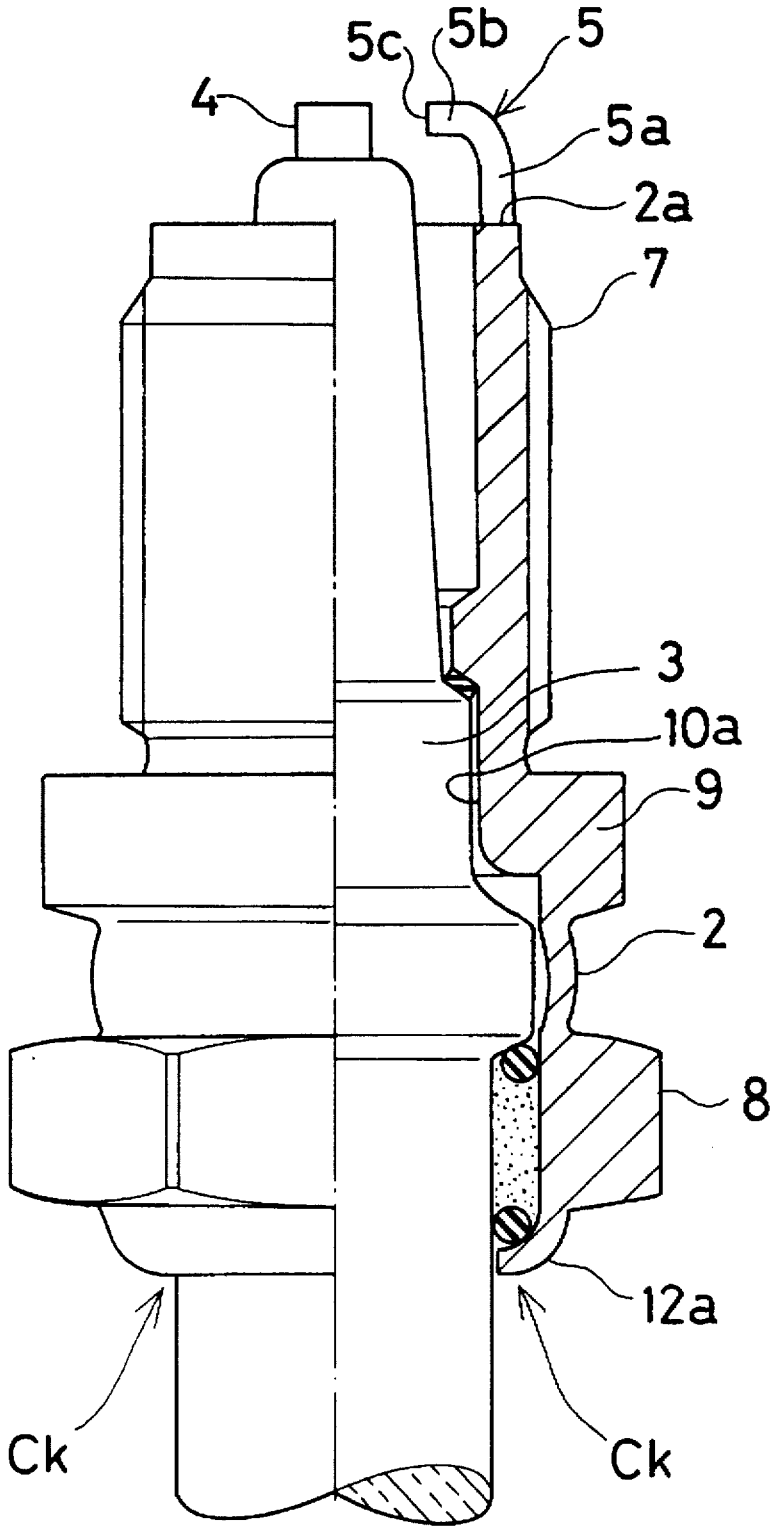
FIG. 11 is a plan view of the spark plug showing a process according to a method of making the spark plug but partly sectioned for the purpose of clarity.

After plating an outer; surface of the metallic shell 2, the insulator 3 is supported in which the center electrode 4 are placed in the axial bore 10*a* of the metallic shell 2, and the insulator 3 is fixedly supported within the metallic shell 2 by caulking a rear end 12*a* of the metallic shell 2 as shown at an arrow Ck in FIG. 11. It is, of course, preferable that the plating is made except for the portion of the outer electrode 5 in which the first spark-erosion resistant noble metal tip 6 is to be placed.

Step 5

Figure 12:
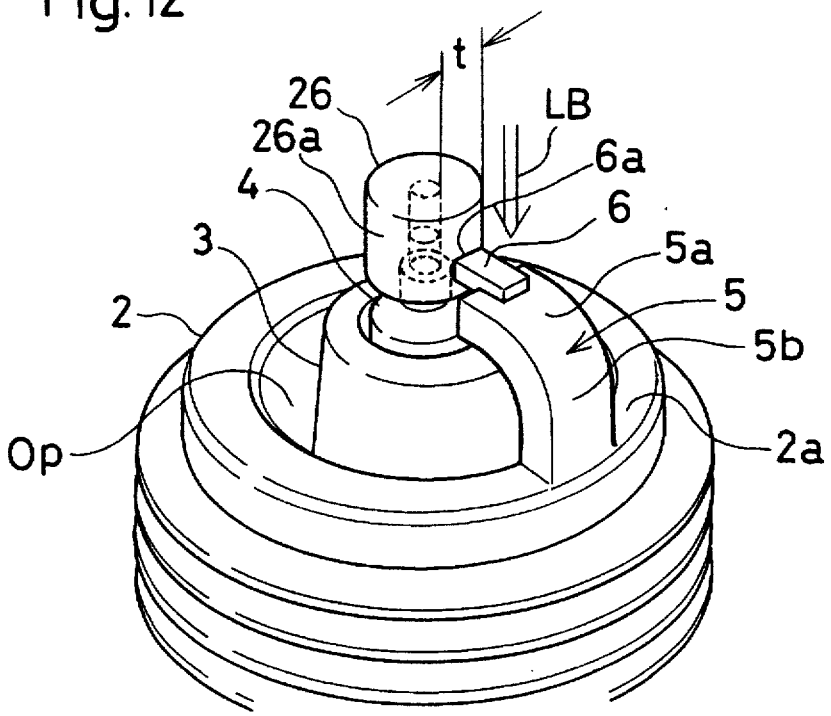
FIG. 12 is an enlarged perspective view of a main part of the spark plug showing a process according to a method of making the spark plug.

As shown in FIG. 12, a spacer ring 26 is placed around the front end of the center electrode 4. The thickness dimension (t) of the spacer ring 26 is uniform all though its circumferential length. The thickness dimension (t) of the spacer ring 26 is such that the distance between the front end 6*a* of the tip 6 and the elevational wall of the center electrode 4 is equal to the spark gap G when the tip 6 is subjected to thermal contraction due to the release of heat after completing the welding procedure.

By-way of illustration, when the spark gap G is (G1 ±0.1) mm, the thickness dimension (t) is {(G1=0.1)±0.05} mm which is smaller than the spark gap G by about 0.1 mm. As a consequence, the thickness dimension (t) is {(0.8=0.1)±0.05} mm when the spark gap G is (0.8±0.1) mm.

Step 6

Then the first spark-erosion resistant noble metal tip 6 is placed on the outer side of the lateral arm 5*b* located opposite to the front open end (Op) of the metallic shell 2 as shown in FIG. 12. In this instance, the front end 6*a* of the tip 6 is brought into engagement with an outer surface 26*a* of the spacer ring 26. In order to keep the tip 6 in position while welding the tip to outer side of the outer electrode 5, it is possible to restrict the tip from inadvertently slipping on the outer electrode 5 without imposing, an excessive depression force. When using the depression force, it is observed that the depression force is small, and the electrode 5 is virtually immune to deformation.

Step 7

Laser beams (LB) are applied locally to the interface between the tip 6 and the outer electrode 5 in the direction of an arrow as shown in FIG. 12. This makes it possible to melt the overlapping portion of the tip 6 and the outer electrode 5 so as to positively weld the tip 6 to the outer electrode 5. In this situation it is observed that the steps 5, 6 or the steps 6, 7 may be carried out concurrently upon making the spark plug 1.

According to the invention, the first spark-erosion resistant noble metal tip 6 is readily secured to the outer electrode 5 with the insulator 8 and. the center electrode 4 placed in the metallic shell 2 since the tip 6 is placed oni the outer side of the lateral arm 5*b* located opposite to the front open end (Op) of the metallic shell 2. With the use of the spacer ring 26, it is possible to obtain the distance between the front end 6*a* of the tip 6 and the elevational wall of the center electrode 4 to meet the certain distance to the spark gap G after completing the welding procedure. This obviates the necessity of adjusting the spark gap G after welding the tip 6 to the outer electrode 5.

Upon securing the tip 6 to the outer electrode 5 by means of the welding technique, the use of the laser beams (LB) eliminates the necessity of tightly pressing the tip 6 against the outer electrode 5, thus protecting the outer electrode 5 against the unfavorable deformation so as to provide a high quality spark plug.

Figure 13:
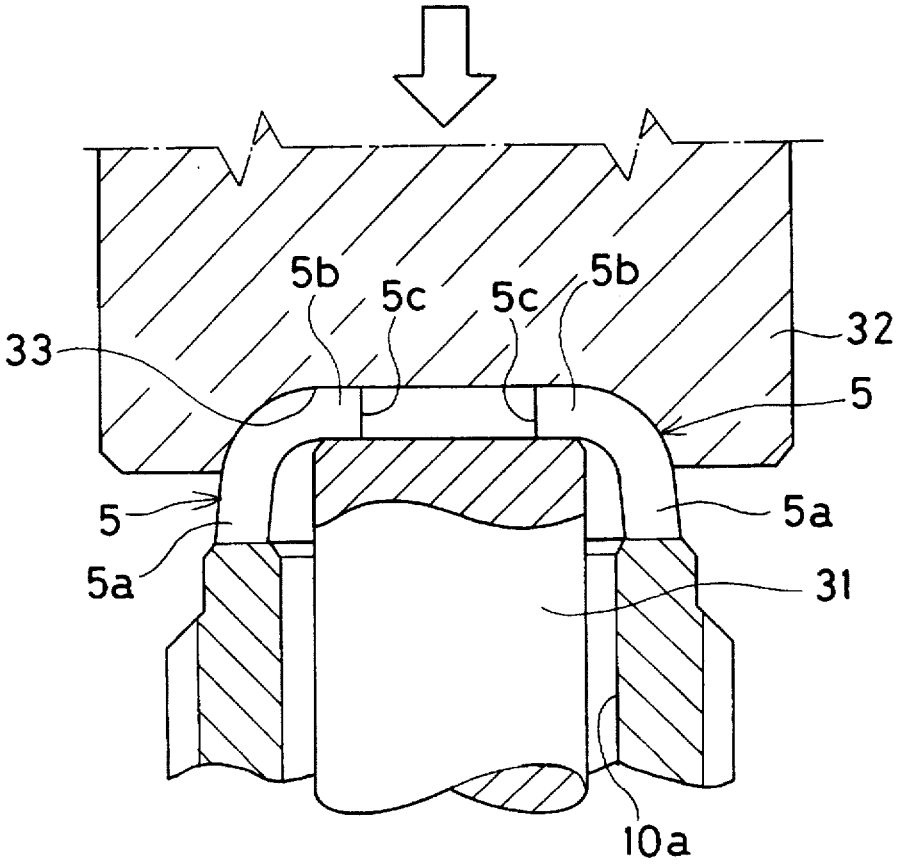
FIG. 13 is a longitudinal cross sectional view showing how the outer electrode is bent into an L-shaped configuration according to a modification form of the invention.
Figure 14:
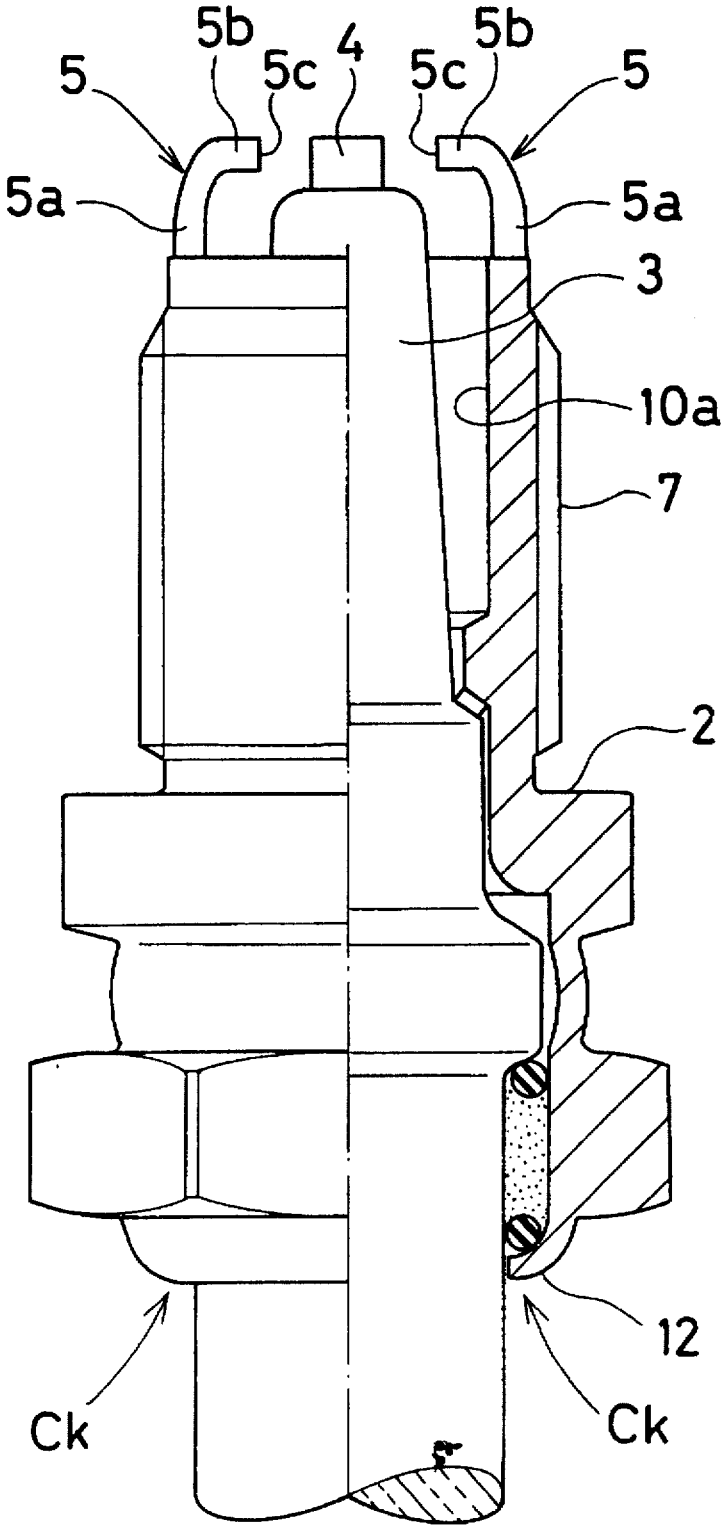
FIG. 14 is a plan view of a main part of the spark plug showing how a spark-erosion resistant noble metal tip is welded to the outer electrode.
Figure 15:
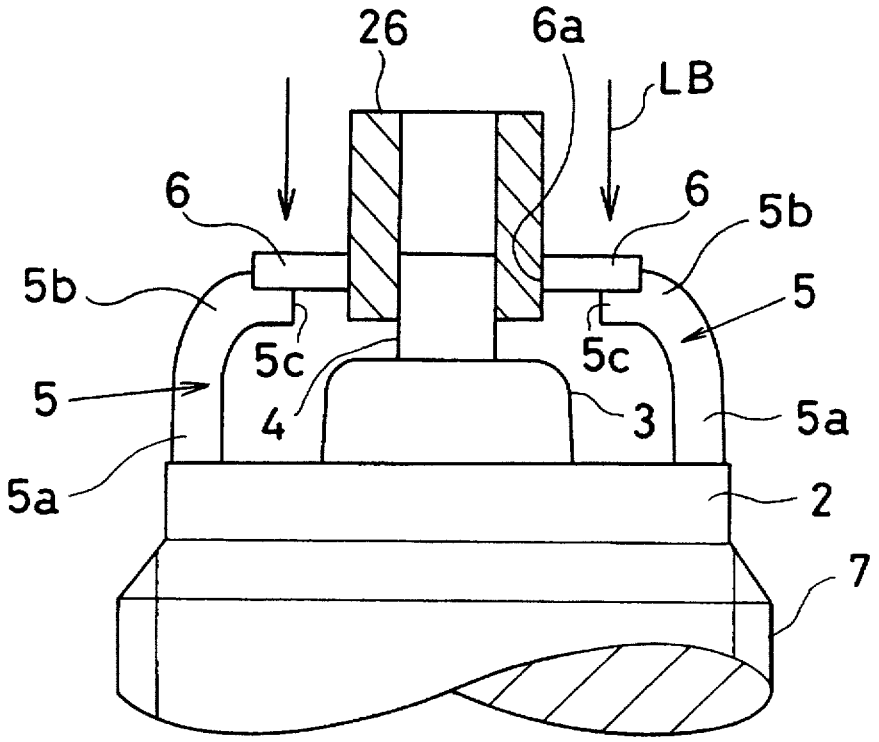
FIG. 15 is an engaged plan view of a front portion of the spark plug to show how the tip is laser welded to the outer electrode.

FIGS. 13 through 15 show a modification form of the invention in which the diametrically opposed outer electrodes 5, 5 are provided in the spark plug 1.

The method of making the spark plug 1 is as follows:

Step 1

On the front end 2*a* of the metallic shell 2, the diametrically opposed outer electrodes 5, 5 are fixedly placed by means of a welding technique in the same manner as described in FIG. 8. In this instance, the lengthwise dimension of the outer electrodes 5, 5 is a predetermined longer considering that the outer electrodes 5, 5 are readily and positively bent into the L-shaped configuration at a next step.

Step 2

Each of the outer electrodes 5, 5 is substantially bent into the L-shaped configuration toward the front open end (Op) of the metallic shell 2 as shown in Fig. 13. In this instance, the lateral arms 5*b*, 5*b* of the outer electrodes 5, 5 extends across the front open end (Op) of the metallic shell 2 in a direction perpendicular to the axial direction of the metallic shell 2. The step is carried out with the use of a bending machine having an inner die 81 and a punch 32. The punch 32 has a forming surface 33 in correspondence toga bending degree of the outer electrodes 5, 5, and the punch 32 moves downward along the axial direction of the metallic shell 2 to depress each of the outer electrodes 5, 5 against the forming surface 33 so as to plastically form the outer electrodes 5, 5 into the L-shaped configuration. It is observed that the outer electrodes 5, 5 are readily and positively bent into the L-shaped configuration without inviting a locally concentrated stress because the lengthwise dimension of the outer electrodes 5, 5 are a predetermined somewhat longer at the preceding step.

Step 3

The redundant end of the outer electrodes 5, 5 are concurrently severed respectively to adjust the position of their front ends 5*c*, 5*c*.

Step 4

After plating an outer surface of the metallic shell 2, the insulator 3 is positioned so that the center electrode 4 is placed in the axial bore 10*a* of the metallic shell 2, and the insulator 3 is fixedly supported within the metallic shell 2 by caulking a rear end 12*a* of the metallic shell 2 as shown in FIG. 14.

Step 5

As shown in FIG. 15, a spacer ring 26 is placed around the front end of the center electrode 4. Then the first spark-erosion resistant noble metal tip 6 is placed on the outer side of the outer electrodes 5, 5 with their front ends 5*c*, 5*c* stopped at the outer surface of the spacer ring 26. While holding the tip 6 in position, the laser beams (LB) are applied to the interface between the tip 6 and the outer electrodes 5, 5 in the direction of an arrow as shown in FIG. 15. This makes it possible to melt the overlapping portion of the tip 6 and the outer electrode 5 so as to positively weld the tip 6 to the outer electrodes 5, 5.

It is noted that the outer electrode 5 may be precisely prepared not to have the unnecessary end instead of providing a longer one before bending the outer electrode 5 into the L-shaped configuration It is also noted that the geometrical shape of the spacer tool may be other than that of the spacer Ping 26 which is used to obtain the certain distance between the tip 6 and the center electrode 4 at the time of welding the tip 6 to the outer electrode 5.

It is appreciated that an inert gas (e.g. argon) welding, electron beam welding or the like may be used instead of the laser beam welding so long as it does not impose an excessive depression force on the outer electrode 5.

It is further appreciated that the metallic shell 2 is located on the drawing papers with the outer electrode upward for the purpose of clarity, however, the metallic shell may be located on the drawing papers upside down, horizontally or obliquely.

What is claimed is:

1. In a method of making a spark plug in which a spark gap is provided between an elevational side of a center electrode axially extended in an insulator supported within a metallic shell and one end of a spark-erosion resistant noble metal tip secured to an outer electrode, the method comprising steps of:

(a) securing an outer electrode to a metallic shell so that at least a portion of the outer electrode is directed inwardly of a front open end of the metallic shell, the outer electrode having an inner surface, an outer surface and an end surface;

(b) supporting a center electrode in an insulator in the metallic shell and (c) attaching a spark-erosion resistant noble metal tip to the outer surface of the outer electrode while maintaining a predetermined distance between an elevational side of the Center electrode and one end of the spark-erosion resistant noble metal tip.

2. A method of making a spark plug according to claim 5, wherein the step (a) includes a first procedure of welding the outer electrode to the metallic shell, and a second procedure of bending the outer electrode into a substantially L-shaped configuration so that an end of the outer electrode is directed inwardly of the front open end of the metallic shell.

3. A method of making a spark plug according to claim 2, wherein a plurality of outer electrtodes are provided, and all the outer electrtodes are concurrently bent into an L-shaped configuration.

4. A method of making a spark plug according to claim 2, wherein said end of the outer electrode is cut to adjust a gap between the end surface of the outer electrode and the elevational side of the center electrode after said second procedure of bending the outer electrode into a substantially L-shaped configuration.

5. A method of making a spark plug according to claim 4, wherein a plurality of outer electrodes are provided, and all the outer electrodes are concurrently bent into a substantially L-shaped configuration.

6. A method of making a spark plug according to claim 1, wherein said step of attaching the metal tip comprises thermally welding an interface between the tip and the outer electrode.

7. A method of making a spark plug according to claim 6, wherein the predetermined distance between an elevational side of a center electrode and one end of the spark-erosion resistant noble metal tip in said attaching step is smaller than the spark gap so that a distance between the elevational side of the center electrode and the one end of the metal tip becomes equal to the spark gap due to thermal contraction of the tip when the tip cools after said step of thermally welding an interface between the tip and the outer electrode.

8. A method of making a spark plug according to claim 7, wherein the step (a) includes a first procedure of welding the outer electrode to the metallic shell, and a second procedure of bending the outer electrode into a substantially L-shaped configuration so that an end of the outer electrode is directed inwardly of the front open end of the metallic shell.

9. A method of making a spark plug according to claim 8, wherein said end of the outer electrode is cut to adjust a gap between the end surface of the outer electrode and the elevational side of the center electrode after said secound procedure of bending the outer electrode into a substantially L-shaped configuration.

10. A method of making a spark plug according to claim 8, wherein a plurality of outer electrodes are provided, and all the outer electrodes are concurrently bent into a substantially L-shaped configuration.

* * * * *

UNITED STATES PATENT AND TRADEMARK OFFICE

CERTIFICATE OF CORRECTION

PATENT NO. : 5,556,315

DATED : September 17, 1996

INVENTOR(S) : Junichi KAGAWA

It is certified that error appears in the above-identified patent and that said Letters Patent is hereby corrected as shown below:

On the title page: Item [56] , please change ", abandoned." to --.--.

Signed and Sealed this

Tenth Day of December, 1996

*Attest:*

*Attesting Officer*

BRUCE LEHMAN

*Commissioner of Patents and Trademarks*